US005215057A

United States Patent [19]

Sato et al.

[11] Patent Number: 5,215,057

[45] Date of Patent: Jun. 1, 1993

[54] ELECTRICALLY-OPERATED THROTTLE ACTUATOR

[75] Inventors: Eiji Sato; Yuzo Kadomukai, both of Ibaraki; Naoyuki Tanaka, Abiko; Teruhiko Minegishi, Katsuta, all of Japan

[73] Assignees: Hitachi, Ltd., Tokyo; Hitachi Automotive Engineering Co., Ltd., Ibaraki, both of Japan

[21] Appl. No.: 931,376

[22] Filed: Aug. 18, 1992

[30] Foreign Application Priority Data

Aug. 21, 1991 [JP] Japan ..... 3-209487

[51] Int. Cl.[5] ..... F02D 11/10

[52] U.S. Cl. ..... 123/400; 123/399

[58] Field of Search ..... 123/361, 396, 399, 400

[56] References Cited

U.S. PATENT DOCUMENTS

| | | | |
|---|---|---|---|
| 4,727,840 | 3/1988 | Nishida et al. | 123/339 |
| 4,787,353 | 11/1988 | Ishikawa et al. | 123/400 X |
| 4,969,437 | 11/1990 | Kolb | 123/399 |
| 5,040,508 | 8/1991 | Watanabe | 123/400 |
| 5,046,575 | 9/1991 | Asayama | 123/399 |
| 5,113,822 | 5/1992 | Asayama | 123/399 X |

FOREIGN PATENT DOCUMENTS 55333 3/1988 Japan .

*Primary Examiner*—Willis R. Wolfe

*Attorney, Agent, or Firm*—Antonelli, Terry, Stout & Kraus

[57] ABSTRACT

There is disclosed an electrically-operated actuator in which a throttle valve is driven by a combination of the rotation of a motor and the operation of an accelerator by the operator, and besides the rotational force of the motor is not so transmitted to an accelerator pedal. This actuator is further provided with a fail-safe function. A parallelogrammic link is constituted by a link member fixedly mounted on a throttle shaft, a link member rotatably mounted on the throttle shaft and operatively connected to the accelerator pedal via a wire, a link fixedly mounted on a shaft rotatably mounted on the link member, and a link member connected to the link members by pins. The throttle shaft is coaxial with a shaft of the motor. A gear in mesh with a gear fixedly mounted on the motor shaft is fixedly mounted on the shaft, thereby forming a differential gear mechanism. Forces of springs act respectively on the throttle shaft and the link member in a direction to close the throttle valve. In order to prevent excessive opening and closing of the throttle due to the run-away of the motor, stoppers limit the angle of rotation of the motor.

9 Claims, 5 Drawing Sheets

ELECTRICALLY-OPERATED THROTTLE ACTUATOR

BACKGROUND OF THE INVENTION

This invention relates generally to an electrically-operated throttle actuator which adjusts the degree of opening of a throttle valve by the use of an electronically-controlled motor to change an amount of intake air into an engine, and more particularly to an electrically-operated throttle actuator which is designed to prevent a rotational force of the motor from being transmitted as a reaction force to an accelerator pedal.

There is an electrically-operated throttle actuator in which the operation of an accelerator by an operator (driver) is effected independently of the rotation of a motor (which operates a throttle), and a throttle valve is opened by the combination of these two operations. In such an electrically-operated throttle actuator, even if an electronic control device is subjected to malfunction, the throttle valve can be fully closed when an amount of operation of the accelerator is rendered to zero. Therefore, generally, such an electrically-operated throttle actuator is provided with a mechanical fail-safe mechanism. An example of such a drive mechanism is a differential mechanism as disclosed in Japanese Patent Unexamined Publication No. 63-55333.

The differential mechanism as disclosed in Japanese Patent Unexamined Publication No. 63-55333 includes many gears, and is complicated in construction, and requires much time and labor for assembling it. Therefore, such a differential mechanism is expensive. Another problem is that when only the motor is driven while keeping the amount of operation of the accelerator constant, a reaction force of the motor is transmitted to the accelerator pedal, so that the operator has a strange sensation.

SUMMARY OF THE INVENTION

It is a first object of this invention to provide an electrically-operated throttle actuator in which a throttle valve is driven by the combination of two operations (that is, the operation of an accelerator by the operator and the rotation of a motor) with a simple mechanism, and besides the rotational force of the motor is not so much transmitted to an accelerator pedal.

A second object of the invention is to equip the electrically-operated throttle actuator provided with a mechanical fail-safe mechanism.

In order to achieve the above first object, according to one aspect of the present invention, there is provided an electrically-operated actuator wherein a throttle shaft having a throttle valve is driven by the rotation of a motor and the operation of an accelerator by an operator, the actuator comprising:

a wire drum, as a first link member, rotatable in response to the operation of the accelerator, the wire drum rotatably bearing the throttle shaft, and the wire drum rotatably bearing a link gear shaft which is rotated by the motor through a differential gear mechanism;

a parallelogrammic link mechanism, including the wire drum as a first link member, connecting the throttle shaft to the link gear shaft; and spring means for urging the throttle shaft in a direction to close the throttle valve.

According to another aspect of the present invention, there is provided an electrically-operated actuator wherein a throttle shaft having a throttle valve is driven by the rotation of a motor and the operation of an accelerator by an operator, the actuator comprising:

a wire drum rotatable in response to the operation of the accelerator, the wire drum rotatably bearing the throttle shaft, and the wire drum rotatably bearing a link gear shaft which is rotated by the motor through a differential gear mechanism;

a parallelogrammic link mechanism connecting the throttle shaft to the link gear shaft;

spring means for urging the throttle shaft in a direction to close the throttle valve;

an accelerator sensor for detecting the amount of operation of the accelerator;

a throttle sensor for detecting the degree of opening of the throttle valve; and a controller for receiving outputs from the accelerator sensor and the throttle sensor, the controller driving the motor to control the degree of opening of the throttle valve.

According to a further aspect of the present invention, there is provided an electrically-operated actuator wherein a throttle shaft having a throttle valve is driven by the rotation of a motor and the operation of an accelerator by an operator, the actuator comprising:

a wire drum rotatable in response to the operation of the accelerator, the wire drum rotatably bearing the throttle shaft, and the wire drum rotatably bearing a link gear shaft which is rotated by the motor through a differential gear mechanism;

a parallelogrammic link mechanism connecting the throttle shaft to the link gear shaft; and spring means urging the throttle shaft in a direction to close the throttle valve;

a shaft of the motor being coaxial with the throttle shaft.

According, to a still further aspect of the present invention, there is provided an electrically-operated actuator in which a throttle shaft having a throttle valve is driven by the rotation of a motor and the operation of an accelerator by an operator; wherein (a) the throttle shaft is coaxial with a shaft of the motor;

(b) there is provided a quadrilateral link mechanism which sequentially comprises a first link member, a second link member, a third link member, a fourth link member, the link mechanism further comprising a first joint between the fourth and first link members, a second joint between the first and second link members, a third joint between the second and third link members, and a fourth joint between the third and fourth link members;

(c) the first joint of the quadrilateral link mechanism fixedly connects the fourth link member to the throttle shaft, the first joint supporting the first link member on the throttle shaft in such a manner that the first link member is rotatable relative to the throttle shaft;

(d) the second joint of the quadrilateral link mechanism supports a link gear shaft on the first link member in such a manner that the link gear shaft is rotatable relative to the first link member, and fixedly connecting the second link member on the link gear shaft;

(e) a motor gear is fixedly mounted on the motor shaft, a link gear in mesh with the motor gear being fixedly mounted on the link gear shaft;

(f) there is provided a throttle shaft return spring always applying an urging force which urges the throttle shaft to rotate in a direction to close the throttle valve;

(g) there is provided an accelerator return spring always applying an urging force which urges the first link member to rotate the throttle shaft in a direction to close the throttle valve; and (h) the first link member receives the force of operation of the accelerator by the operator in a direction opposite to the direction of the urging force of the accelerator return spring.

In the electrically-operated actuator according to the present invention, there is provided an auxiliary gear in mesh with a motor gear, and an auxiliary spring is provided between the auxiliary gear and a wire drum (a first link member), and the auxiliary spring applies an urging force to the wire drum via the auxiliary gear in a direction opposite to the direction of an urging force of a throttle shaft return spring.

In order to achieve the above second object, in the electrically-operated actuator according to the present invention, there is provided mechanical stopper means for limiting the rotation angle of the motor. The mechanical stopper means is directly provided on the motor shaft or on an auxiliary gear.

In the electrically-operated throttle actuator, the link gear shaft rotatably supported by the first link member can revolve around an axis of the motor shaft, and the link gear connected to this link gear shaft is in mesh with the motor gear connected to the motor shaft, and can revolve around this motor gear. Thus, these constitute the differential gear mechanism. With this construction, when the accelerator is operated while fixing the rotation of the motor, the first link member (accelerator-operating link member) rotates together with the link gear, and this rotation is transmitted to the throttle shaft via the quadrilateral link mechanism. In contrast, when the motor is rotated while fixing the accelerator-operating link member, this rotation is transmitted to the throttle shaft via the link gear and the quadrilateral link mechanism. The mechanical fail-safe mechanism is provided by limiting the rotation angle of the motor by the mechanical stoppers, and besides the engine output can be adjusted to a certain degree when the controller is subjected to a malfunction.

In this specification, the term "to close (or open) the throttle shaft" means "to rotate the throttle shaft in a direction to close (or open) the throttle valve". The term "the degree of opening of the throttle shaft" means "the rotation angle of the throttle shaft corresponding to the degree of opening of the throttle valve".

The throttle shaft return spring always applies the urging force to the throttle shaft to urge the throttle shaft in the closing direction, and also the accelerator return spring always applies the urging force to the accelerator-operating link member to urge the throttle shaft in the closing direction.

Even if the operator moves the first link member (the accelerator-operating link) by operating the accelerator in a free condition (that is, in a deenergized condition of the motor), the throttle shaft remains closed by the urging force of the throttle shaft return spring. When the accelerator-operating link member is further moved, the motor is stopped at the position of the closed-side stopper, and therefore beyond this position the amount of operation of the accelerator is proportional to the rotation of the throttle shaft. In contrast, when the motor is driven in the throttle shaft-opening direction while keeping the accelerator operation amount at zero, the throttle shaft is opened in proportion to the rotation angle of the motor. The maximum opening degree of the throttle shaft at this time is determined by the position of the open-side stopper, and therefore the position of the stopper is so set that the engine will not run away due to the run-away of the motor.

In the normal operating condition, the throttle shaft is opened to a position where the combination of the accelerator-pressing force and the motor rotation force is balanced with the urging forces of the throttle shaft return spring and the accelerator return spring. Here, if the arrangement is made so that the urging force of the throttle shaft return spring will not be so influenced by the rotation of the throttle shaft (for example, the spring constant of the throttle shaft return spring is made smaller), the accelerator-pressing force is balanced with the urging force of the accelerator return spring, and the rotational force of the motor is balanced with the urging force of the throttle shaft return spring. Therefore, the rotational force of the motor will not be transmitted as a reaction force to the accelerator pedal, and the throttle shaft is operated by the combination of the accelerator operation amount and the motor rotation.

If a spring having an ordinary spring constant is used as the throttle shaft return spring, the auxiliary gear in mesh with the motor gear, as well as the auxiliary spring, is provided. In this case, the auxiliary gear is driven by the rotational force of the motor, and the rotational force of the auxiliary gear is transmitted to the accelerator-operating link member via the auxiliary spring. With this arrangement, the reaction force of the throttle shaft return spring produced as a result of the rotation of the motor can be balanced with the spring force of the auxiliary spring, and therefore the rotational force of the motor is not transmitted as the reaction force to the accelerator pedal.

DESCRIPTION OF THE PREFERRED EMBODIMENT

Figure 1:
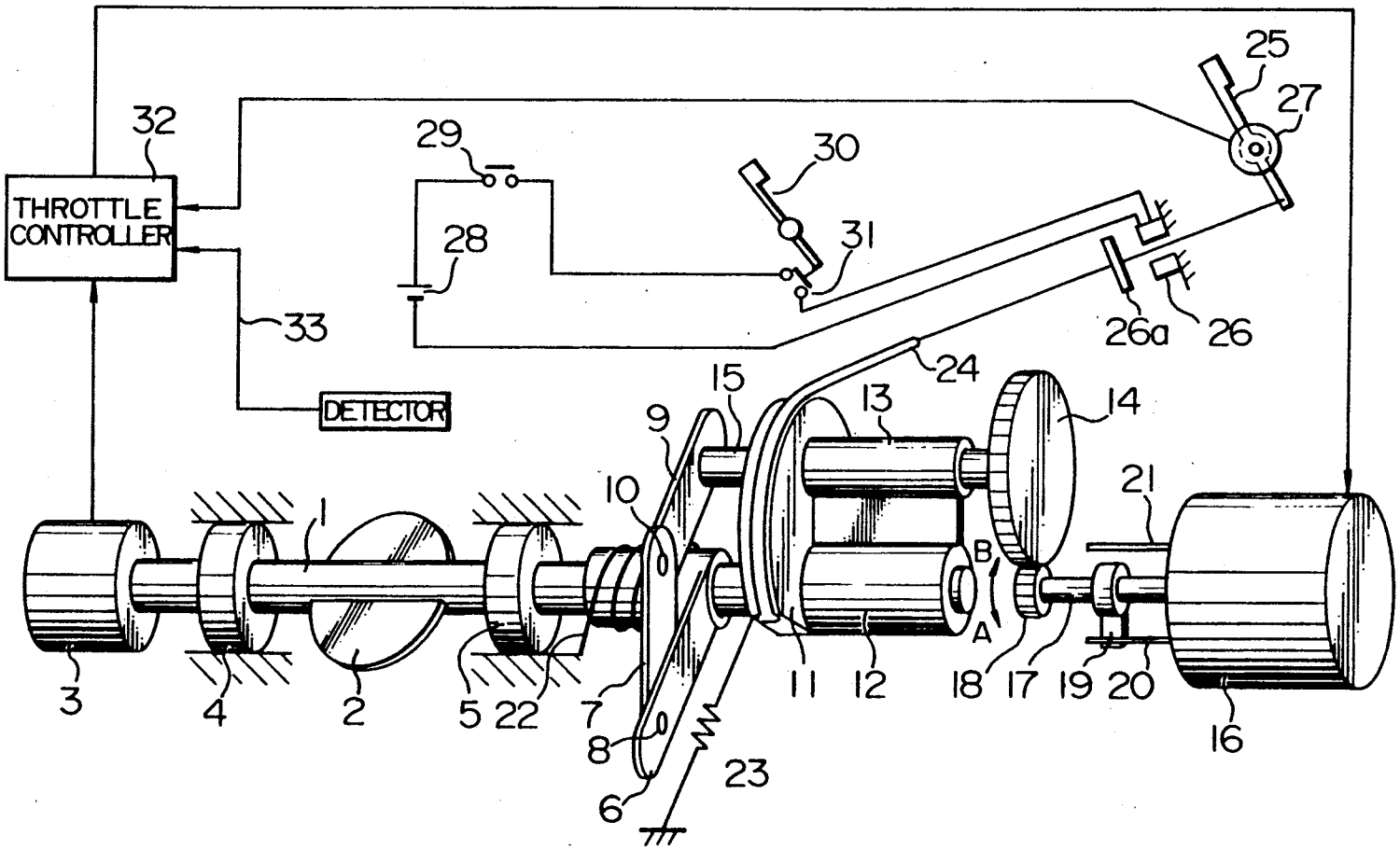
FIG. 1 is view showing the construction of an electrically-operated throttle actuator according to a first embodiment of the present invention.
Figure 2:
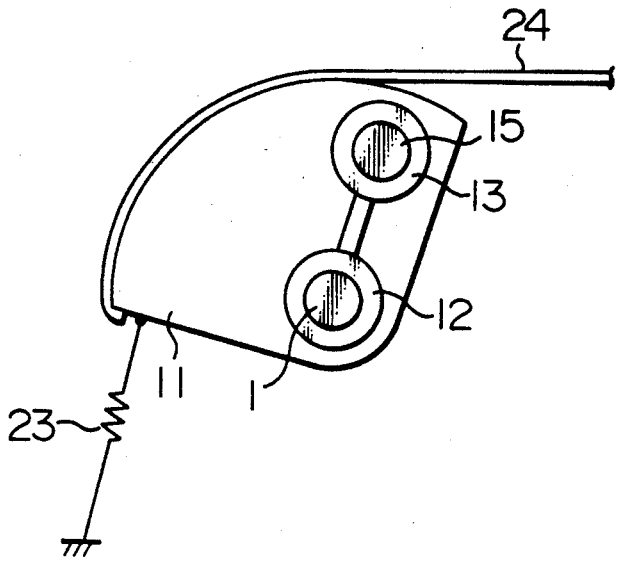
FIG. 2 is a front-elevational view of a wire drum in the first embodiment.
Figure 3:
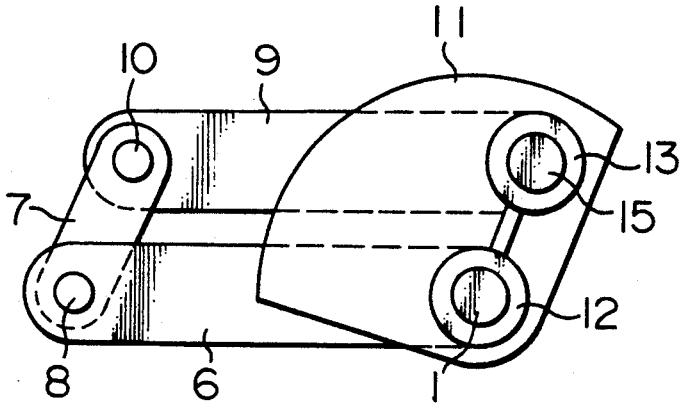
FIG. 3 is a front-elevational view of a parallelogrammic link mechanism in the first embodiment.

FIG. 1 is a view showing a basic construction of an electrically-operated throttle actuator according to a first embodiment of the present invention. A throttle valve 2, as well as a sensor 3 for detecting the degree of opening of a throttle, is mounted on a throttle shaft 1. The throttle shaft 1 is rotatably supported or borne by bearings 4 and 5, and its rotation angle is detected by the sensor 3. A link member 6 is fixedly mounted on the throttle, shaft 1, and the link member 6 is connected to a link member 7 by a pin 8, and the link member 7 is connected to a link member 9 by a pin 10. Two bearing portions 12 and 13 are provided on a wire drum 11 (FIG. 2 shows this wire drum 11 as seen from the right side in FIG. 1) which also serves as an accelerator operating-link member. The wire drum 11 is supported on the throttle shaft 1 through the bearing portion 12 so as to rotate relative to the throttle shaft 1 about the throttle shaft 1. A link gear 14 and the link member 9 are fixedly mounted on a link gear shaft 15, and the link gear shaft 15 is borne by the bearing portion 13 so that this shaft 15 can rotate relative to the wire drum 11. With this arrangement, the wire drum 11 and the link members 9, 7 and 6 jointly constitute a parallelogrammic link mechanism, as shown in FIG. 3. Assuming that these link members 11, 9, 7 and 6 are first, second, third and fourth link members, respectively, the bearings 12 and 13, the connecting pins 10 and 8 constitute first, second, third and fourth joints of the parallelogrammic link mechanism, respectively. It is not always necessary that this parallelogrammic link mechanism should be parallelogrammic, and it may be a quadrilateral link mechanism having a similar function.

A motor gear 18 is mounted on a rotation shaft (motor shaft) 17 of a motor 16, and the motor gear 18 is in mesh with the link gear 14. The throttle shaft 1 is substantially coaxial with the motor shaft 17. With this arrangement, a differential gear mechanism is constituted. Stopper pins 20 and 21 are mounted on the motor 16, and the motor 16 can rotate until a lever 19 mounted on the motor shaft 17 is brought into contact with the stopper pins 20 and 21. A throttle shaft return spring 22 is in the form of a coil spring wound around the throttle shaft 1, and urges the throttle shaft 1 in its closing direction (that is, a counterclockwise direction as seen from the right side of FIG. 1). A link return spring 23 connected to the wire drum 11 also acts in a direction to close the throttle shaft 1 (that is, in a counterclockwise direction as seen from the right side of FIG. 1).

The periphery of the wire drum 11 is in the shape of an arc forming a part of a circle having the center disposed on the center (axis) of the bearing portion 12. A wire 24 fixed at its one end to the wire drum 11 is wound around the periphery of the wire drum 11, and the wire 24 is connected to an accelerator pedal 25. An attraction iron piece 26*a* of an electromagnet 26 is mounted on the wire 24, and an accelerator operation amount sensor 27 for detecting the amount of operation of the accelerator (that is, the amount of pressing-down of the accelerator pedal 25) is mounted on the accelerator pedal 25. The accelerator operation amount sensor 27 may be mounted on the wire drum 11. Alternatively, the rotation angle of the motor shaft 17 is detected, and the accelerator operation amount can be found from the degree of opening of the throttle shaft (which is detected by the sensor 3) and the rotation angle of the motor shaft 17. An electrical circuit for the electromagnet 26 comprises a battery 28 as a power source, an automatic cruise switch 29 and a brake switch 31 operated in response to the operation of a brake pedal 30, these switches 29 and 31 being connected together in series. A detection signal from the throttle opening degree sensor 3 and a detection signal from the accelerator operation amount sensor 27 are fed to a throttle controller 32, and an instruction signals from other controllers or detectors 33 are also fed to the throttle controller 32. In accordance with these signals, the throttle controller 32 drives the motor 16.

Next, the basic operation of the electrically-operated throttle actuator of the above construction will now be described. In a de-energized condition of the motor 16 (in this condition, the motor shaft 17 is free, and can rotate in so far as the stopper pins 20 and 21 restrain the rotation of this motor shaft 17), when the accelerator pedal 25 is pressed down, the wire drum 11 is rotated until the urging force of the link return spring 23 is balanced with the force of pressing-down of the accelerator pedal 25. In this case, the throttle shaft 1 is held in its fully closed condition by the throttle shaft return spring 22 (that is, the throttle shaft 1 is held at such an angle of rotation that the throttle valve 2 is fully closed). Here, when the motor shaft 17 is rotated in a direction of arrow A by the throttle controller 32, its rotational force is transmitted to the throttle shaft 1 via the gears 18 and 14, the link gear shaft 15 and the link members 9, 7 and 6, and the throttle shaft 1 rotates against the bias of the throttle shaft return spring 22, so that the throttle valve 2 is opened. However, the reaction force of the throttle shaft return spring 22 is also transmitted to the accelerator pedal 25, and therefore in order that the operator may not have a sensation of difference, the throttle shaft return spring 22 need to be of such a type that its urging force does not change so much with respect to the rotation of the throttle shaft 1. For example, if the throttle shaft return spring 22 has a small spring constant, the reaction force applied to the accelerator pedal 25 as a result of the rotation of the motor shaft 17 is small. On the other hand, when the accelerator pedal 25 is pressed down with the rotation angle of the motor shaft 17 kept constant, the wire drum 11 is rotated about the throttle shaft 1 in a direction of arrow B, and the link gear 14 rotates on the motor gear 18, and this motion is transmitted to the throttle shaft 1 via the link gear shaft 15 and the link members 9, 7 and 6, so that the throttle shaft 1 is rotated, thereby opening the throttle valve 2. Thus, the rotation angle of the throttle shaft 1 is a combination (synthesis) of the amount of pressing-down of the accelerator pedal 25 (that is, the rotation angle of the wire drum 11) and the rotation angle of the motor shaft 17.

Next, reference is now made to a fail-safe function in the case of a malfunction of the throttle controller 32 or a malfunction of the motor 16 in the above embodiment. This fail-safe function is achieved by the differential mechanism and the stopper pins 20 and 21 in the above embodiment. The stopper pin 20 prevents the motor 16 from running away in the direction A (that is, in the opening direction), thereby preventing the throttle shaft 1 from being excessively opened against the will of the operator. The stopper pin 21 prevents the motor 16 from running away in the opposite direction B (that is, in the closing direction).

Figure 4:
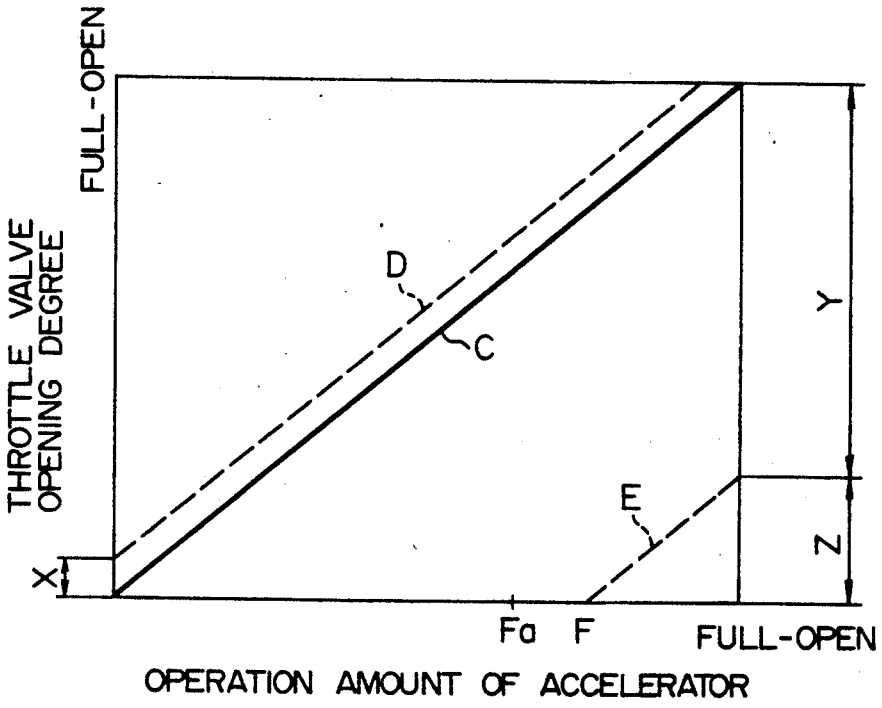
FIG. 4 is a diagrammatical illustration showing the range of operation of the electrically-operated throttle actuator.

In a normal operating condition, the rotation angle of the motor shaft 17 is changed under the control of the throttle controller 32. The range of operation of the electrically-operated throttle actuator of this embodiment effected at this time is shown in FIG. 4. The abscissa axis represents the amount of operation of the accelerator, and the ordinate axis represents the degree of opening of the throttle shaft. When the rotation angle of the motor shaft 17 is kept substantially constant, the amount of operation of the accelerator is proportional to the degree of opening of the throttle shaft 1, as indicated by a line C. The position of the stopper pin 20 is so determined that the throttle shaft 1 is opened by an amount X (FIG. 4), with the accelerator operation amount kept to zero, when the lever 19 is brought into contact with the stopper pin 20 as a result of the rotation of the motor 16 in the direction A. By doing so, even if the motor shaft 17 runs away in the direction A (that is, the direction to open the throttle valve), the degree of opening of the throttle shaft 1 will not exceed the value X. By setting this opening degree X of the throttle shaft 1 within a range not causing the run-away of the engine, the safety can be secured. This can be used for controlling the idling rotation of the engine. Therefore, the control of the idling speed, which has heretofore been effected by the use of an additional auxiliary valve other than a throttle valve, can be effected by the throttle valve. In contrast, if the motor 16 runs away in the direction (the direction B) to close the throttle shaft 1, the engine output is lowered, and therefore this acts in a safe direction. However, when the throttle shaft 1 is fully closed by the rotation of the motor 16 in the direction B, the engine output can not be increased even if the accelerator is pressed down, so that the vehicle can not run. In such a case, the angle range in which the throttle shaft 1 can be closed by the motor 16 in the fully-opened condition of the accelerator (in which the accelerator pedal 25 is pressed down to the maximum degree) is set to Y as shown in FIG. 4. By doing so (that is, by determining the position of the stopper pin 21 to achieve this), the degree of opening of the throttle shaft 1 can be controlled by an amount Z (FIG. 4) by the accelerator pedal 25 even when the motor 16 runs away in the direction B or when the motor 16 is locked.

The range of the rotation angle of the throttle shaft which can be controlled by the electrically-operated throttle actuator of this embodiment is a region interposed between broken lines D and E in FIG. 4. Particularly, the closing of the throttle shaft 1 by the motor 16 is used for a traction control of an automobile (which controls the driving force acting on a tire of the automobile so as to prevent a slip of the tire) and an automatic cruise control (by which the speed of the automobile is automatically maintained at a set target speed). In the case of the traction control, the slip rate at the time of driving the automobile is inputted as the instruction signal 33 to the throttle controller 32, and the throttle controller 32 drives the motor 16 to control the throttle shaft 1 in the closing direction. In the case of the automatic cruise control, when the operator turns on the setting switch 29, the electromagnet 26 is excited, and then when the accelerator pedal 25 is pressed down to a certain degree, the wire 24 is fixed by the electromagnet 26. Therefore, the wire drum 11 is fixed, and the speed of the vehicle is controlled by the motor 16 only in the direction to close the throttle shaft 1. The position of the accelerator to be fixed by the electromagnet 26 is set to be below a position F (for example, a position Fa) in FIG. 4. The operation region at this time is that portion on the left side of the position Fa of the region between the broken lines D and E. The automatic cruise is released either by turning off the setting switch 29 or by pressing down the brake pedal 30 to turn off the switch 31. The setting switch 29 is of the type which once turned off, is never turned on unless this switch is again activated.

In this embodiment, although the electromagnet 26 is used for fixing the wire drum 11, a pneumatic actuator utilizing a negative pressure of an engine intake system may be used. Further, although the wire drum 11 is driven directly by the wire 24, a link mechanism (not shown) may be provided between the wire 24 and the wire drum 11 so that the wire drum 11 can be driven indirectly by the wire 24.

Figure 5:
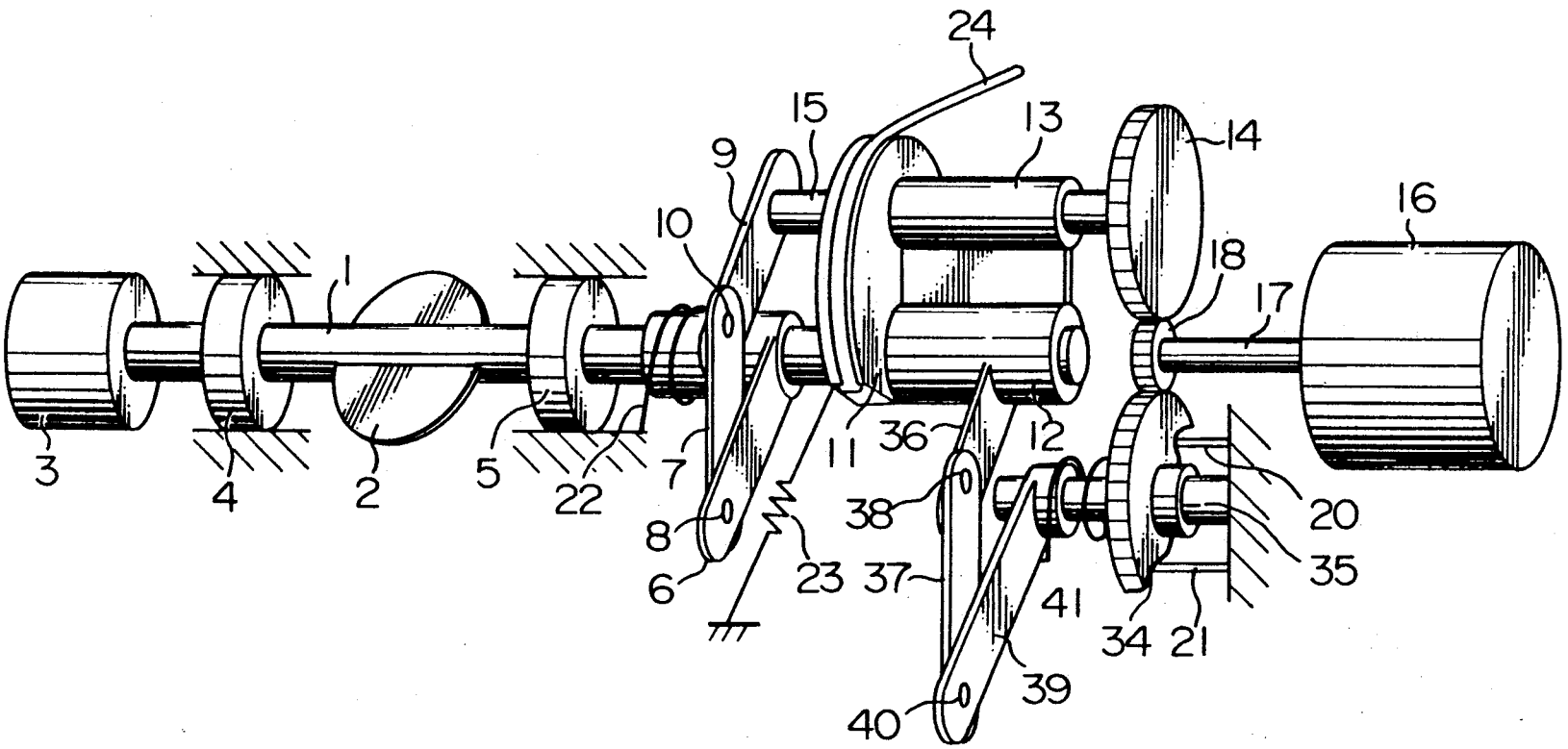
FIG. 5 is a view showing the construction of an electrically-operated throttle actuator according to a second embodiment of the present invention.

FIG. 5 shows another embodiment of the invention in which the rotational force of a motor 16 is not transmitted to the accelerator pedal even if the spring constant of a throttle shaft return spring 22 is large. In the construction shown in FIG. 5, there is provided an auxiliary gear 34 in mesh with the motor gear 18, and this auxiliary gear 34 can rotate on an auxiliary gear shaft 35. The range of rotation of the motor 16 is determined by limiting the rotation of the auxiliary gear 34 by the stopper pins 20 and 21. A link member 36 is fixed to the wire drum 11, and the link member 36 and a link member 37 are connected together by a pin 38. The link member 37 and a link member 39 are connected together by a pin 40, and the link member 39 is supported on the auxiliary gear shaft 35 via a bearing portion so that the link member 39 can rotate relative to the auxiliary gear shaft 35 about this shaft 35. An auxiliary spring 41 is provided between the link member 39 and the auxiliary gear 34, and the opposite ends of this spring 41 are retained on the link member 39 and the auxiliary gear 34, respectively. The auxiliary spring 41 urges the link member 39 in a clockwise direction as seen from the right side in FIG. 5, and the urging force of this spring 41 becomes greater as the auxiliary gear 34 angularly moves in the clockwise direction. Except for the above-mentioned points, the construction of FIG. 5 is similar to that of FIG. 1.

Figure 6:
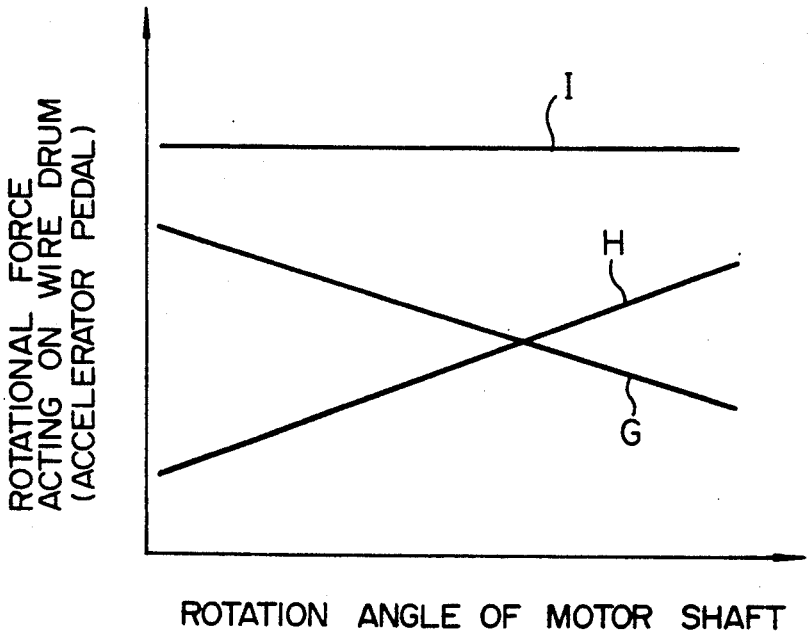
FIG. 6 is a diagrammatical illustration showing a rotational force acting on a wire drum of the electrically-operated throttle actuator of FIG. 5.

In the construction of FIG. 5, the rotational force applied to the wire drum 11 (and hence the accelerator pedal) by the rotation of the motor 16 when the wire drum 11 is fixed is shown in FIG. 6. In FIG. 6, the abscissa axis represents the rotation angle of the motor shaft 17, and the ordinate axis represents the rotational force acting on the wire drum 11. Because of the relation between the rotation angle of the motor shaft 17 and the urging force of the throttle shaft return spring 22, the rotational force applied to the wire drum 11 by the spring 22 is represented by a line G slanting downward to the right. On the other hand, the rotational force applied to the wire drum 11 by the auxiliary spring 41 via the link members 39, 37 and 36 is represented by a line H slanting upward to the right. Since these two rotational forces are combined together, the rotational force acting on the wire drum 11 is flat relative to the rotation angle of the motor shaft 17 as indicated by a line I. Therefore, the reaction force is not transmitted to the accelerator pedal even when the motor 16 is rotated.

When the motor 16 runs away, the end of the auxiliary gear 34 in mesh with the motor gear 17 is brought into contact with the stopper pin 20 or 21, and the range of operation of the throttle shaft 1 is the same as shown in FIG. 4. Therefore, the engine is prevented from running away, and the safety can be secured. Further, the combination of the initial urging force of the throttle shaft return spring 22 and the initial urging force of the link return spring 23 is set to a value greater than the initial urging force of the auxiliary spring 41. By doing so, even if the motor 16 is rendered into a free condition as a result of a malfunction of the controller, the throttle shaft 1 is fully closed, thereby securing the safety.

In the present invention, the mechanism for operating the throttle shaft by combining the accelerator operation and the motor rotation together can be achieved by the simple construction having a small number of gears. Therefore, the construction can be inexpensive. Further, when the accelerator operation is rendered to zero in the event of a malfunction of the controller, the throttle valve is closed to lower the engine output, thereby securing the safety of the vehicle or the like. Further, since the reaction force is not transmitted to the accelerator pedal when the motor is operated, the operator will not have a strange sensation.

What is claimed is:

1. An electrically-operated actuator wherein a throttle shaft having a throttle valve is driven by the rotation of a motor and the operation of an accelerator by an operator, said actuator comprising:

a wire drum rotatable in response to the operation of said accelerator, said wire drum rotatably bearing said throttle shaft, and said wire drum rotatably bearing a link gear shaft which is rotated by said motor through a differential gear mechanism;

a parallelogrammic link mechanism connecting said throttle shaft to said link gear shaft; and spring means for urging said throttle shaft in a direction to close said throttle valve;

a rotation shaft of said motor being coaxial with said throttle shaft.

2. An electrically-operated actuator in which a throttle shaft having a throttle valve is driven by the rotation of a motor and the operation of an accelerator by an operator; wherein (a) said throttle shaft is coaxial with a shaft of said motor;

(b) there is provided a quadrilateral link mechanism which sequentially comprises a first link member, a second link member, a third link member, a fourth link member, said link mechanism further comprising a first joint between said fourth and first link members, a second joint between said first and second link members, a third joint between said second and third link members, and a fourth joint between said third and fourth link members;

(c) said first joint of said quadrilateral link mechanism fixedly connects said fourth link member to said throttle shaft, said first joint supporting said first link member on said throttle shaft in such a manner that said first link member is rotatable relative to said throttle shaft;

(d) said second joint of said quadrilateral link mechanism supports a link gear shaft on said first link member in such a manner that said link gear shaft is rotatable relative to said first link member, and fixedly connecting said second link member on said link gear shaft;

(e) a motor gear is fixedly mounted on said motor shaft, a link gear in mesh with said motor gear being fixedly mounted on said link gear shaft;

(f) there is provided a throttle shaft return spring always applying an urging force which urges said throttle shaft to rotate the same in a direction to close said throttle valve;

(g) there is provided an accelerator return spring always applying an urging force which urges said first link member to rotate said throttle shaft in a direction to close said throttle valve; and (h) said first link member receives the force of operation of said accelerator by the operator in a direction opposite to the direction of the urging force of said accelerator return spring.

3. An electrically-operated actuator wherein a throttle shaft having a throttle valve is driven by the rotation of a motor and the operation of an accelerator by an operator, said actuator comprising:

a wire drum rotatable in response to the operation of said accelerator, said wire drum rotatably bearing said throttle shaft, and said wire drum rotatably bearing a link gear shaft which is rotated by said motor through a differential gear mechanism;

a parallelogrammic link mechanism connecting said throttle shaft to said link gear shaft;

spring means for urging said throttle shaft in a direction to close said throttle valve;

an accelerator sensor for detecting an amount of operation of said accelerator;

a throttle sensor for detecting a degree of opening of said throttle valve; and a controller for receiving outputs from said accelerator sensor and said throttle sensor, said controller driving said motor to control the degree of opening of said throttle valve.

4. The electrically-operated actuator according to claim 3, in which there is provided an auxiliary gear in mesh with a motor gear, an auxiliary spring being provided between said auxiliary gear and a wire drum, and said auxiliary spring applying an urging force to said wire drum via said auxiliary gear in a direction opposite to the direction of an urging force of a throttle shaft return spring.

5. An electrically-operated actuator wherein a throttle shaft having a throttle valve is driven by the rotation of a motor and the operation of an accelerator by an operator, said actuator comprising:

a wire drum rotatable in response to the operation of said accelerator, said wire drum rotatably bearing said throttle shaft, and said wire drum rotatably bearing a link gear shaft which is rotated by said motor through a differential gear mechanism;

a parallelogrammic link mechanism connecting said throttle shaft to said link gear shaft; and spring means for urging said throttle shaft in a direction to close said throttle valve.

6. The electrically-operated actuator according to claim 5, in which there is provided mechanical stopper means for limiting the rotation angle of said motor.

7. The electrically-operated actuator according to claim 5, in which there is provided an auxiliary gear in mesh with a motor gear, an auxiliary spring being provided between said auxiliary gear and a wire drum, and said auxiliary spring applying an urging force to said wire drum via said auxiliary gear in a direction opposite to the direction of an urging force of a throttle shaft return spring.

8. The electrically-operated actuator according to claim 2, in which said auxiliary gear includes the mechanical stopper means for limiting the rotation angle of said motor.

9. The electrically-operated actuator according to claim 7, in which there is provided mechanical stopper means for limiting the rotation angle of said motor.

* * * * *